US009151508B2

(12) United States Patent
Han et al.

(10) Patent No.: US 9,151,508 B2
(45) Date of Patent: Oct. 6, 2015

(54) NETWORK SYSTEM EQUIPPED WITH AIR CONDITIONER AND CONTROL METHOD THEREOF

(71) Applicants: Seungjin Han, Seoul (KR); Woojoo Choi, Seoul (KR); Seonghun Lee, Seoul (KR)

(72) Inventors: Seungjin Han, Seoul (KR); Woojoo Choi, Seoul (KR); Seonghun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 434 days.

(21) Appl. No.: 13/655,724

(22) Filed: Oct. 19, 2012

(65) Prior Publication Data

US 2013/0103205 A1 Apr. 25, 2013

(30) Foreign Application Priority Data

Oct. 21, 2011 (KR) ..... 10-2011-0108242

(51) Int. Cl.
*F24F 3/06* (2006.01)
*F24F 11/00* (2006.01)

(52) U.S. Cl.
CPC ..... *F24F 3/065* (2013.01); *F24F 11/006* (2013.01); *F24F 2011/0061* (2013.01); *F24F 2011/0072* (2013.01)

(58) Field of Classification Search
USPC ..... 700/276, 277; 62/175, 259.1, 132
See application file for complete search history.

(56) References Cited

U.S. PATENT DOCUMENTS

| | | | | |
|---|---|---|---|---|
| 5,271,453 | A * | 12/1993 | Yoshida et al. | 165/205 |
| 7,243,004 | B2 * | 7/2007 | Shah et al. | 700/276 |
| 7,770,403 | B2 * | 8/2010 | Kojima et al. | 62/132 |
| 8,121,735 | B2 * | 2/2012 | Saruwatari et al. | 700/276 |
| 2003/0070439 | A1 * | 4/2003 | Shim | 62/175 |
| 2011/0126567 | A1 * | 6/2011 | Asanuma et al. | 62/259.1 |

FOREIGN PATENT DOCUMENTS

EP 1 953 468 A2 8/2008

OTHER PUBLICATIONS

European Search Report for Application 12170285.6 dated Mar. 11, 2013.

* cited by examiner

*Primary Examiner* — Kidest Bahta
(74) *Attorney, Agent, or Firm* — KED & Associates, LLP

(57) ABSTRACT

A network system equipped with an air conditioner and a control method may be provided. The network system may include: the air conditioner operating for air conditioning of a set space; a control device for updating set data in the air conditioner, and a control unit equipped in the air conditioner and for receiving update data from the control device. The control unit may include: an external memory for storing update data received from the control device, and an internal memory for selectively storing the update data stored in the external memory based on whether an update execute signal is received from the control device.

13 Claims, 7 Drawing Sheets

-Related Art-

NETWORK SYSTEM EQUIPPED WITH AIR CONDITIONER AND CONTROL METHOD THEREOF

CROSS-REFERENCE TO RELATED APPLICATION

The present application claims priority under 35 U.S.C. 119 and 35 U.S.C. 365 to Korean Patent Application No. 10-2011-0108242, filed Oct. 21, 2011, the subject matter of which is hereby incorporated by reference.

BACKGROUND

1. Field

The present disclosure relates to a network system having an air conditioner and a control method thereof.

2. Background

An air conditioner is a consumer electronic device that maintains air in a room to be in a most appropriate status based on use and purpose. For example, the air conditioner may be used to control a room to be in a cool state in summer and to be in a warm state in winter. The air conditioner may also be used to regulate humidity of a room, and clean the air in a room for a pleasant and clean state. The air conditioner may have a cooling cycle of compression, condensation, expansion, and evaporation processes of a refrigerant. Accordingly, the air conditioner may provide a cooling operation or a heating operation of a set space (e.g. an indoor space).

An air conditioner may be a separate type air conditioner having a separate indoor unit and outdoor unit, and/or an integrated type air conditioner having an integrated indoor unit and outdoor unit, based on whether an indoor unit and an outdoor unit are separated or are not separated. The outdoor unit may include a compressor and an indoor heat exchanger for exchanging heat with outdoor air. The indoor unit may include an indoor heat exchanger for exchanging heat with indoor air.

When a cooling operation is performed in a cooling cycle, the outdoor heat exchanger may serve as a condenser, and the indoor heat exchanger may serve as an evaporator. On the contrary, when a heating operation is performed in a heating cycle, the indoor heat exchanger may serve as a condenser, and the outdoor heat exchanger may serve as an evaporator.

FIG. 1 shows a network system for operating an air conditioner that includes an indoor unit and an outdoor unit. Other arrangements may also be provided.

FIG. 1 shows that a network system may include a plurality of indoor units 1, a plurality of outdoor units 2 and a control device 5. The indoor units 1 may discharge conditioned air into an indoor space. The outdoor units 2 may be in a communication enabled connection to the plurality of indoor units 1. The control device 5 may deliver a control signal from the indoor unit 1 to at least one of the outdoor units 2.

The plurality of indoor units 1 may include a first indoor unit, a second indoor unit . . . and an Nth indoor unit. The plurality of outdoor units 2 may include a first outdoor unit, a second outdoor unit . . . and an Nth outdoor unit.

The control device 5 may deliver a control signal to the specific outdoor unit 2 that matches the first indoor unit 1 when the control signal is provided (or generated) from the first indoor unit 1 (from among the plurality of indoor units 1). The control device 5 may only serve to deliver control information of the indoor unit 1 to the outdoor unit 2 after simply matching the indoor unit 1 to the outdoor unit 2.

However, the air conditioner may differently set state information or function information (i.e., operating standards) based on outdoor unit conditions and/or indoor loads. The state information or function information may be necessarily updated periodically and/or based on predetermined standards.

However, since there are limitations in remotely updating the above information, a user who controls the air conditioner may feel inconvenient. For example, a service technician may personally visit a place having an installed air conditioner and may inconveniently update the state information or function information.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
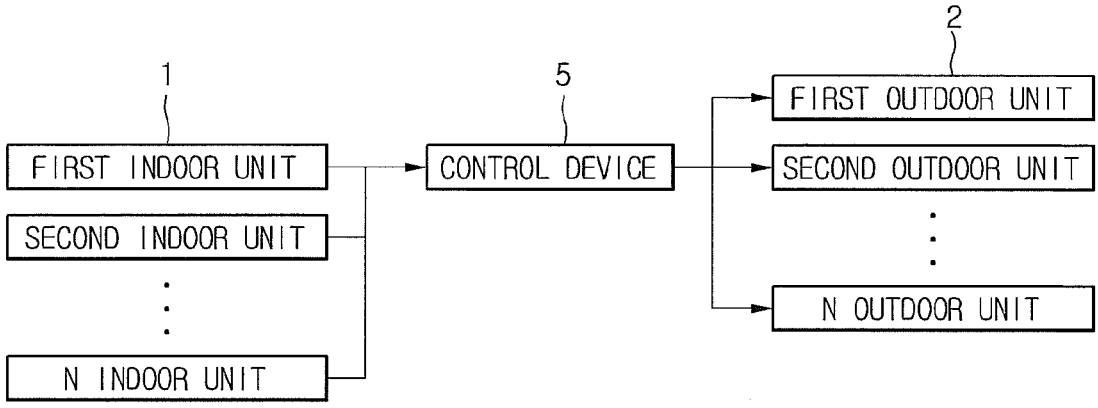
FIG. 1 shows a network system having with an air conditioner.
Figure 2:
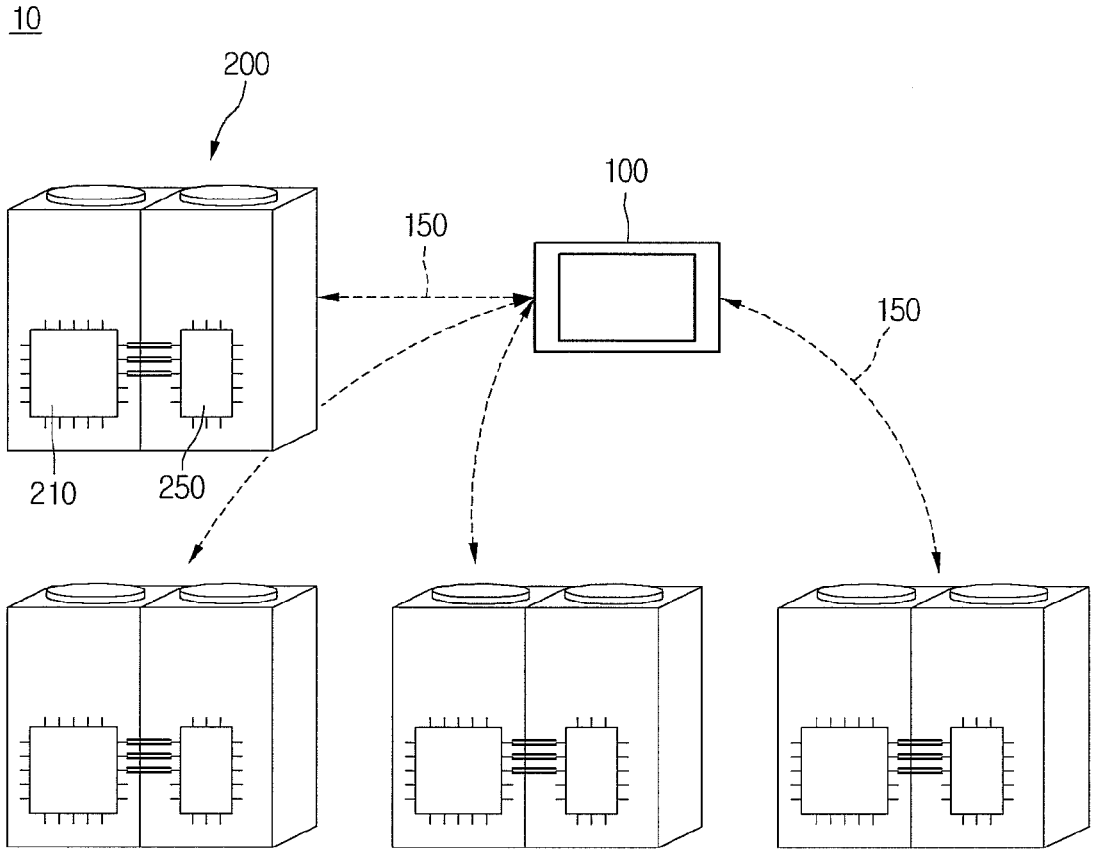
FIG. 2 shows a network system according to an example embodiment.
Figure 3:
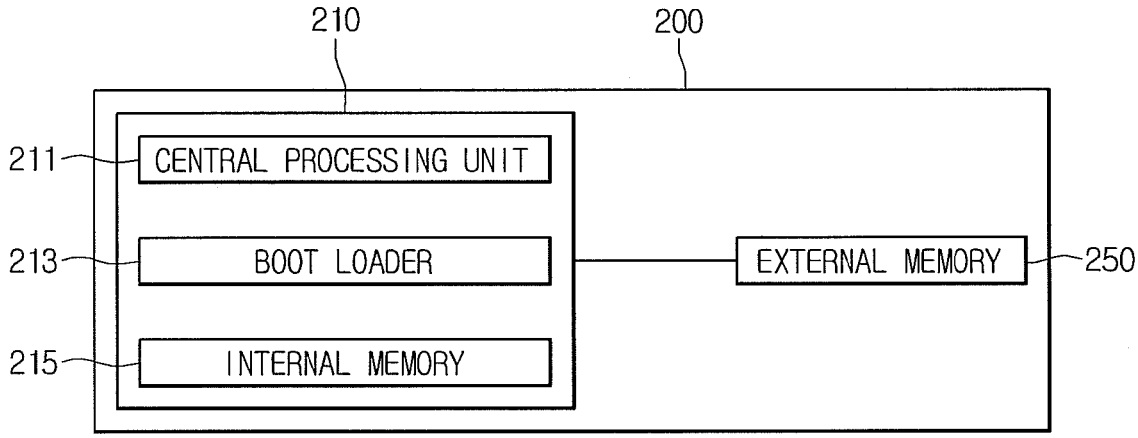
FIG. 3 is a block diagram of an outdoor unit according to an example embodiment.

FIG. 2 shows a network system according to an example embodiment. FIG. 3 is a block diagram of an outdoor unit according to an example embodiment. Other embodiments and configurations may also be within the scope of the present invention.

FIGS. 2 and 3 show that a network system 10 may include a control device 100 for transmitting data (i.e., an update target) to an outdoor unit 200 (or a plurality of outdoor units), and/or for delivering an update execute signal to the outdoor unit 200 (or the plurality of outdoor units). The data (i.e., the update target) may be update data or on-boarding data. The outdoor unit 200 may be a plurality of outdoor units. The network system 10 may also include an indoor unit and/or a plurality of indoor units.

The network system 10 may operate an air conditioner by using the control device 100, the outdoor units 200 and the indoor units.

An air conditioner may set state information or function information in advance, according to an outdoor air condition and/or an indoor load (e.g. a number of operating indoor units), while operating according to a refrigerant cycle. Such information may be updated according to a predetermined condition. The update data may relate to the information.

The update data may include various temperature conditions (such as a temperature value or an outdoor temperature condition for a cycle) and/or an operating condition (such as an operating frequency or an operation rate) of a compressor.

The control device 100 may deliver a control signal (recognized by the indoor unit) to the outdoor unit 200. The control signal may be a predetermined signal for changing an operating condition of an air conditioner based on an input command when a user inputs a predetermined command through the indoor unit. The control device 100 may monitor an operating state of the outdoor unit 200, and/or may control an operation of the outdoor unit 200 based on the information recognized by the indoor unit (or provided by the indoor unit).

A first communication interface 150 may be provided between the control device 100 and the plurality of outdoor units 200. The first communication interface 150 may be a RS485 communication method as a serial communication. The RS485 communication method may provide a multi-party to multi-party communication.

The outdoor unit 200 may include a control unit for outdoor unit 210 and an external memory 250. The control unit for outdoor unit 210 may control an operation of the outdoor unit 210 or an air conditioner. The external memory 250 may additionally and/or temporarily store data to be processed by the control unit for outdoor unit 210.

The external memory 250 may be a nonvolatile memory to provide stable information storage of data. For example, the external memory 250 may be a flash memory. If the external memory 250 is configured with a nonvolatile memory, even when an on-boarding process of the update data fails, the data may be recovered so that stability of data processing may be secured.

As shown in FIG. 3, the control unit for outdoor unit 210 may include a central processing unit 211, a boot loader 213 and an internal memory 215. The central processing unit 211 may process data. The internal memory 215 may store data to be processed by the central processing unit 211. The boot loader 213 may read update data (or images) stored in the external memory 250 to store (e.g. on-board or write) into the internal memory 215. The boot loader 213 may initialize the data of the internal memory 215 or the internal memory 215 where the update data are to be stored.

The internal memory 215 may include ROM and/or RAM. For ease of description, the external memory 250 may be referred to as a first memory and the internal memory 215 may be referred to as a second memory.

With the boot loader 213, the control unit for outdoor unit 210 may include a first area to process a control signal (i.e., a control image) from the control device 100 and a second area to process the update data (i.e., an on-boarding image).

The control unit for outdoor unit 210 may control an outdoor unit, as shown in FIG. 2. The control unit for outdoor unit 210 may also provide overall controlling of an air conditioner (i.e., a control unit in a broad sense). A mounting position of a control unit (for controlling an air conditioner) is not limited to an outdoor unit. The control unit may be provided in an indoor unit. For example, in an integrated type air conditioner, a control unit may be provided therein.

Figure 4:
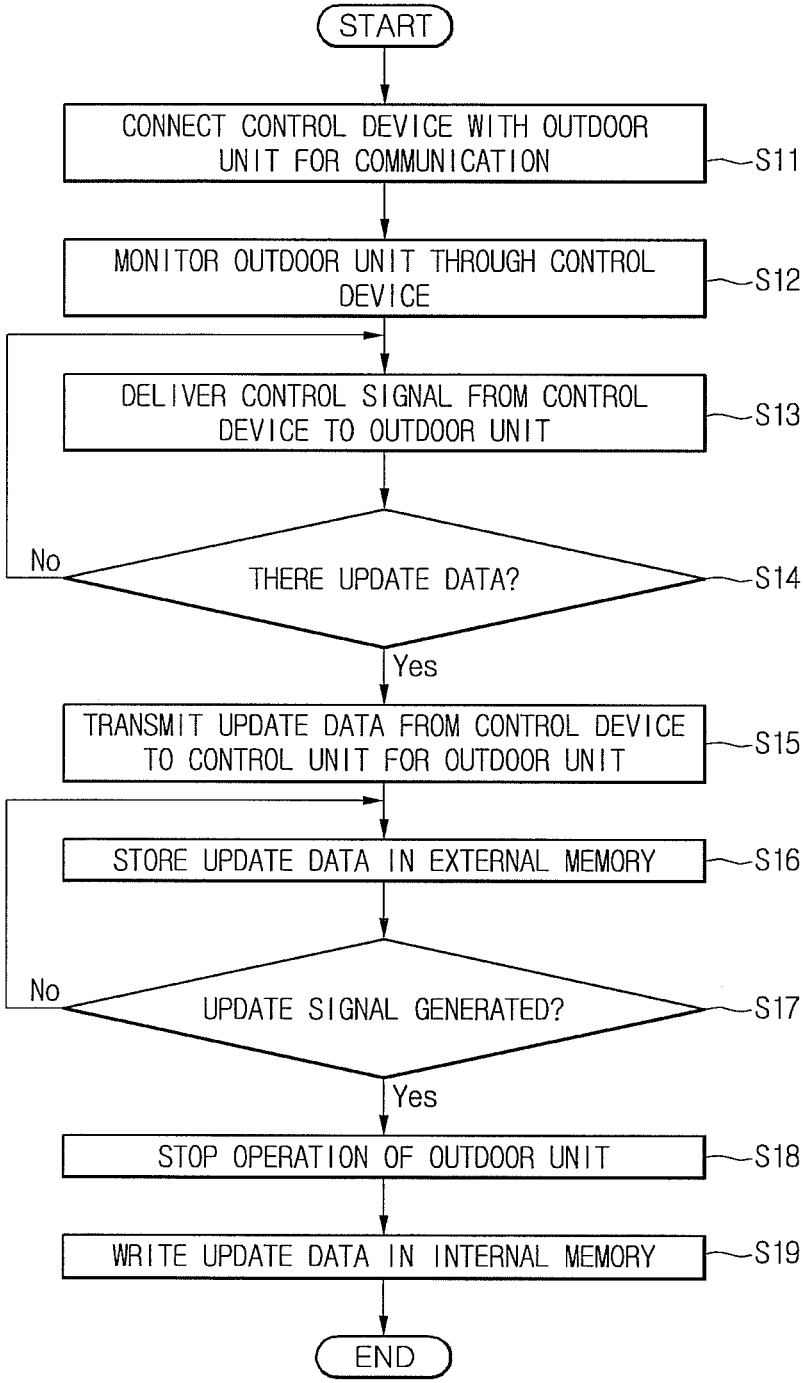
FIG. 4 is a flowchart of a control method according to an example embodiment.
Figure 5:
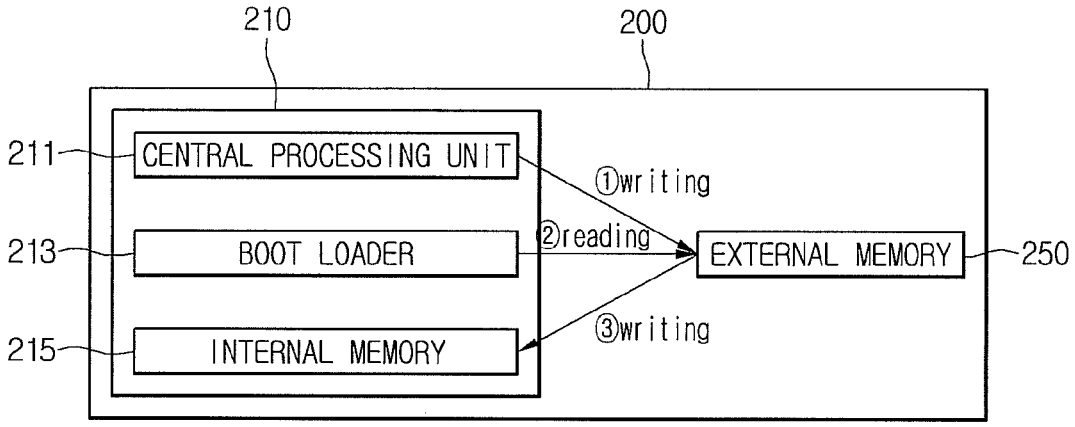
FIG. 5 is a block diagram of a processing operation of update data in an outdoor unit according to an example embodiment.

FIG. 4 is a flowchart of a control method according to an example embodiment. FIG. 5 is a block diagram of an operation for processing update data in an outdoor unit according to an example embodiment. Other embodiments and configurations may also be within the scope of the present invention.

Referring to FIGS. 4 and 5, while the air conditioner operates in operation S11, a communication connection may be provided between the control device 100 and the outdoor unit 200. The control device 100 may monitor an operating state of the outdoor unit 200 in operation S12.

When a predetermined control signal relating to an operation of the outdoor unit 200 is recognized (or determined) by the air conditioner (e.g. a predetermined operating command is input to the outdoor unit 200), the control device 100 may deliver the control signal to the outdoor unit 200 in operation S13. Based on the control signal, the outdoor unit 200 may operate in relation to a refrigerant cycle drive. For example, when an operation of the air conditioner is turned off or a desired temperature in an indoor space changes, operations of a compressor and/or a blower fan may be performed.

During such a process, a determination may be made in operation S14 whether there are data that are to be updated in the outdoor unit 200. Whether there are data to be updated may be determined (or recognized) when the control device 100 monitors an operating state or operating information of the outdoor unit 200. If there are the update data, the update data may be transmitted, in operation S15, from the control device 100 to the control unit for indoor unit 210.

Once the update data are transmitted to the control unit for outdoor unit 210 in operation S16, the central processing unit 211 may write the update data in the external memory 250, such as shown as ① in FIG. 5. The update data are to be stored in the external memory 250 until an update execute signal is determined (or recognized). An operation of storing the update data may be performed several times in operation S16.

While the update data are stored in the external memory 250, a determination (or recognition) may be made in operation S17 whether an update execute signal occurs or not. The determination may be based on an automatically generated signal when a predetermined command is input through the control device 100 or an operation of the outdoor unit 200 stops.

More specifically, when an operator of the control device 100 inputs a predetermined command for update, an operation of the outdoor unit 200 may stop in operation S18. That is, when data updating is performed, an operation of the outdoor unit 200 may stop.

Moreover, an operation of the outdoor unit 200 may stop in response to a predetermined control signal from the control device 100. For example, the predetermined control signal may include a power off command being input to an indoor unit. At this point, when the control device 100 may monitor an operation stop state of the outdoor unit 200, the control device 100 may automatically transmit an update execute signal to the outdoor unit 200.

Once the update execute signal occurs, the update data may be written from the external memory 250 to the internal memory 215. More specifically, the boot loader 213 may read the update data stored in the external memory 250, such as shown as ② in FIG. 5, and may write the update data in the internal memory 215, such as shown as ③ in FIG. 5.

While an update execute signal and a control signal of an outdoor unit are substantially simultaneously received, control data and on-boarding data may be sequentially processed in the control unit for outdoor unit 210 (and/or may be stored in the internal memory 215). For example, according to amount or format of data, the update execute signal and the control signal may be alternately processed (and/or stored) at a time (in operation S19).

Accordingly, even when the update data are transmitted from the control device 100 to the outdoor unit 200, the update data are not directly stored in the internal memory 215, but rather the update data are stored in the external memory 250 until an update execute signal is received. Once the update execute signal is received, the update data are stored in a batch. Therefore, the update data are easily and promptly processed.

While the update data are processed, an air conditioner system and/or an outdoor unit 200 may stop. However, data may be processed in a batch so that an operation stop state of the air conditioner system or the outdoor unit may be minimized.

Additionally, data may be simultaneously updated from the control device 100 to the plurality of outdoor units 200, so that an update process is convenient and relatively instant.

Another example embodiment may now be described. Compared to the previous embodiment, there are differences in some components and a control method of a network system. Thus, the differences may be mainly described, and description and reference numerals of the previous embodiment may be cited with respect to the same portion as the previous embodiment.

Figure 6:
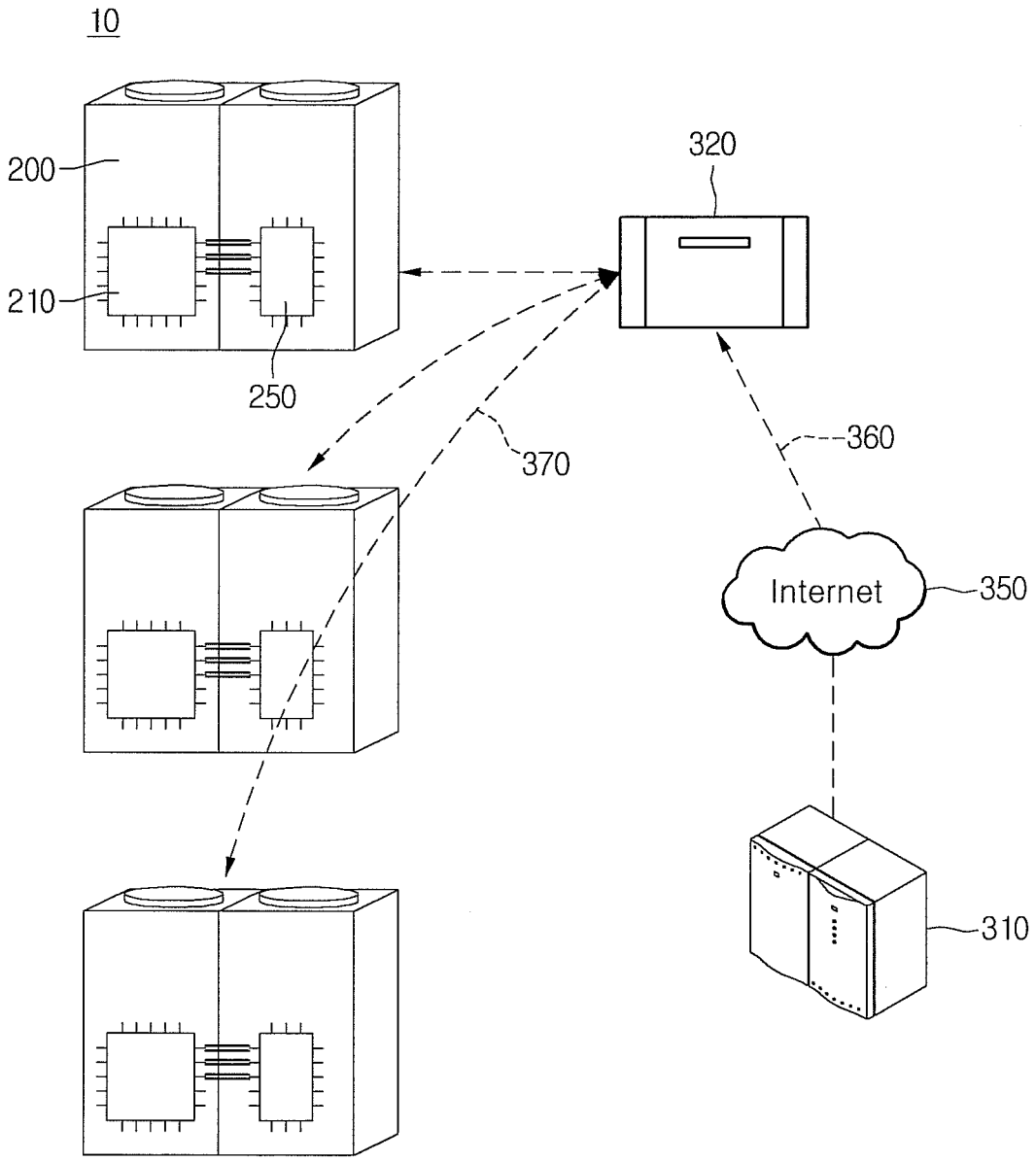
FIG. 6 shows a network system according to an example embodiment.
Figure 7:
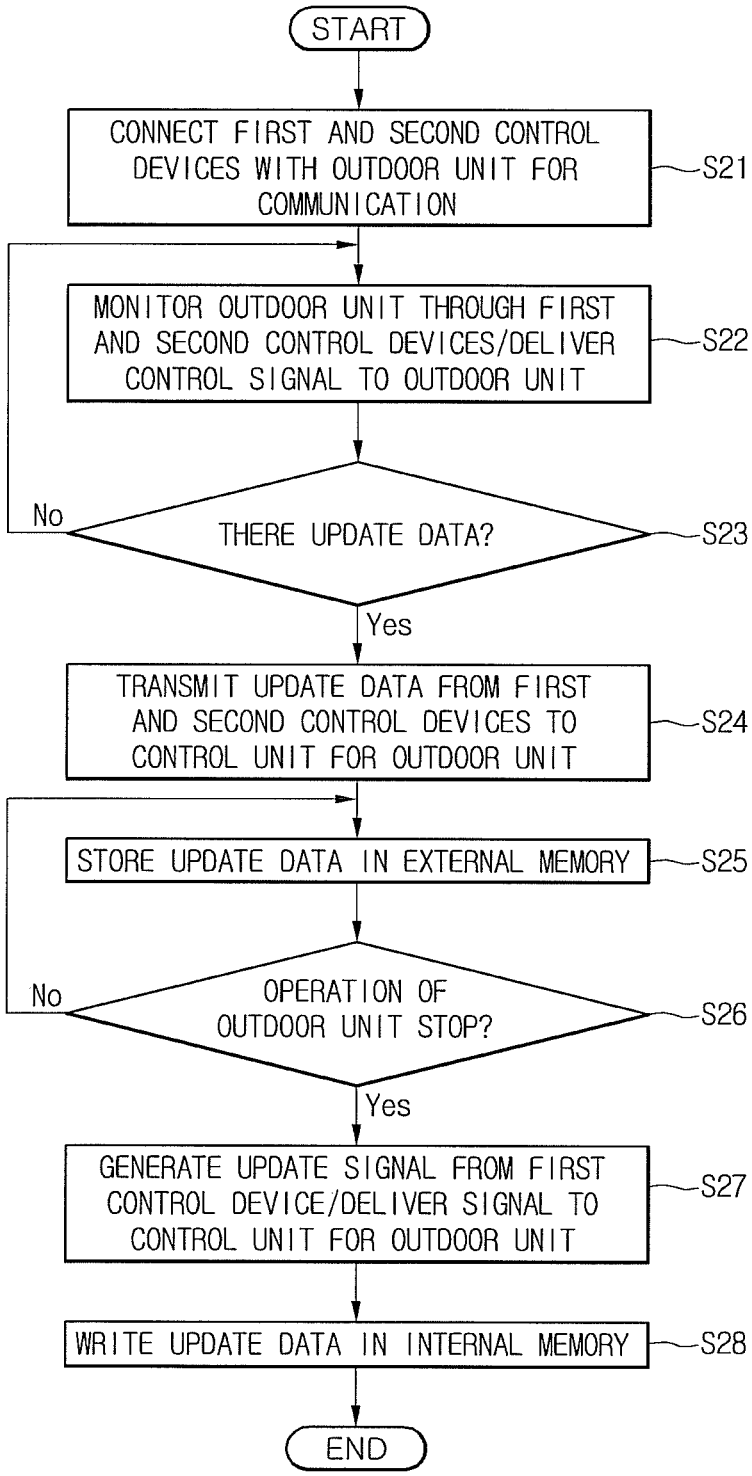
FIG. 7 is a flowchart of a control method according to an example embodiment.

FIG. 6 shows a network system according to an example embodiment. FIG. 7 is a flowchart of a control method according to an example embodiment. Other embodiments and configurations may also be within the scope of the present invention.

As shown in FIG. 6, the network system 10 may include control devices 310 and 320 for transmitting data (i.e., an update target) to a plurality of outdoor units 200, and/or for providing (or delivering) an update execute signal to the plurality of outdoor units 200.

The plurality of control devices 310 and 320 may include a first control device 310 and a second control device 320. The first control device 310 may monitor an operating state of the plurality of outdoor units 200 and/or may transmit update data and/or an update execute signal. The second control device 320 may transmit data and/or a signal transmitted from the first control device 310 to the plurality of outdoor units 200 in a communication enabled connection with the first control device 310.

The first control device 310 and/or the second control device 320 may provide (or deliver) a control signal recognized by the indoor unit to the outdoor unit 200. The control signal may be a predetermined signal for changing an operating condition of an air conditioner based on an input command when a user inputs a predetermined command through the indoor unit. The first control device 310 and/or the second control device 320 may monitor an operating state of the outdoor unit 200, and/or may control an operation of the outdoor unit 200 based on the information recognized by the indoor unit.

The second control device 320 may be provided in a space or a building where the plurality of outdoor units 200 are provided. The first control device 310 may be remotely spaced from the plurality of outdoor units 200 or the second control device 320. For example, the second control device 320 may be provided in a control center that controls the outdoor unit 200 and/or the air conditioner.

The first control device 310 may control a plurality of second control devices 320. A first communication interface 360 may be provided between the first control device 310 and the second control device 320. The first communication interface 360 may include a TCP/IP method relating to a standard protocol that allows data transmission through the internet 350.

A second communication interface 370 may be provided between the second control device 320 and each of the plurality of outdoor units 200. The second communication interface 370 may include the RS485 communication method. The second control device 320 may serve as a converter for converting a data format delivered through the first communication interface 360 into a data format that conforms to the second communication interface 370.

Each of the outdoor units 200 may separately include a control unit for outdoor unit 210 and an external memory 250. The control unit for outdoor unit 210 may control an operation of the respective outdoor unit 210 and/or an air conditioner. The external memory 250 may additionally and/or temporarily store data to be processed in the control unit for outdoor unit 210. Descriptions of a detailed structure and operation of the control unit for outdoor unit 210 and the external memory 250 may be provided above with respect to the previous embodiment.

A control method of a network system may be described with respect to FIG. 7.

Referring to FIG. 7, while the air conditioner operates in operation S21, a communication connection may be provided between the first and second control devices 310 and 320 and the plurality of outdoor units 200. In operation S22, the first and second control devices 310 and 320 may monitor an operating state of the outdoor unit 200 (or plurality of outdoor units) and may deliver, to the outdoor unit 200, a control signal for an operation of the outdoor unit 200.

When a predetermined control signal relating to an operation of the outdoor unit 200 is recognized (or determined) by the air conditioner (e.g. a predetermined operating command is input to the outdoor unit 200), the first and second control devices 310 and 320 may deliver the control signal to the outdoor unit 200 in operation S22. Based on the control signal, the outdoor unit 200 may operate in relation to a refrigerant cycle drive.

During such a process, a determination may be made in operation S23 whether there are data that are to be updated in the outdoor unit 200. Whether there are data to be updated may be determined (or recognized) when the control device 100 monitors an operating state or operating information of the outdoor unit 200. If there are the update data, the update data may be transmitted from the first and second control devices 310 and 320 to the control unit for outdoor unit 210 in operation S24.

Once the update data are transmitted to the control unit for outdoor unit 210 in operation S24, the central processing unit 211 may write the update data in the external memory 250, such as shown as ① in FIG. 5. The update data are to be stored in the external memory 250 until an update execute signal is recognized (or determined). An operation of storing the update data may be performed several times in operation S25.

While the update data are stored in the external memory 250, a determination (or recognition) may be made in operation S26 whether the outdoor unit 200 operates or stops. If the outdoor unit 200 stops, an update execute signal may be generated from the first control device 310, and the update execute signal may be delivered to the control unit for outdoor unit 210 via the second control device 320. That is, based on whether the outdoor unit 200 stops, the update execute signal may be automatically generated from the first control device 310 in operation S27.

The update execute signal may be generated in response to a predetermined command input through the first control device 310 or the second control device 320. When a predetermined command is input through the first control device 310 or the second control device 320, the outdoor unit 200 may stop.

Once the update execute signal occurs, the update data may be written from the external memory 250 to the internal memory 215. More specifically, the boot loader 213 may read the update data stored in the external memory 250, such as shown as ② in FIG. 5, and may write the update data in the internal memory 215, such as shown as ③ in FIG. 5)

While an update execute signal and a control signal of an outdoor unit are substantially simultaneously received, control data and on-boarding data may be sequentially processed in the control unit for outdoor unit 210 (and/or may be stored in the internal memory 215 in operation S28).

Accordingly, even when the update data are transmitted from the first and second control devices 310 and 320 to the outdoor unit 200, the update data are not directly stored in the internal memory 215, but rather the update data are stored in the external memory 250 until an update execute signal is received. Once the update execute signal is received, the update data are stored in a batch. Therefore, the update data may be easily and promptly processed.

According to a network system equipped with an air conditioner, data regarding operations of the air conditioner may be remotely updated, so that the air conditioner may be easily managed.

An external memory may be provided to an outdoor unit and update data may be stored therein. The stored data may be loaded on a control unit for outdoor unit in batches, so that an update processing time may be shortened. Accordingly, while the data are loaded on the control unit for outdoor unit, a time that an outdoor unit or an air conditioner stops may be shortened.

Moreover, since data are updated in a plurality of outdoor units at a time, an update time may be shortened.

Additionally, since data (i.e., an update target) are first stored in an external memory and loaded on a control unit for outdoor unit when a specific signal is received, even if an on-boarding process of the data fails, the data may not be damaged. That is, even when the on-boarding process fails, it may be recovered by using the data stored in the external memory.

Embodiments may provide a network system having an air conditioner, whose information is easily updated by improving a part of a structure of a network system that controls the air conditioner.

A network system having an air conditioner may include: the air conditioner operating for air conditioning of a set space; a control device for updating set data in the air conditioner, and a control unit equipped in the air conditioner for receiving update data from the control device. The control unit may include: an external memory for storing update data received from the control device, and an internal memory for selectively storing the update data stored in the external memory based on whether an update execute signal is received from the control device. The external memory may be separate from the internal memory.

A control method of a network system that includes an air conditioner (with an indoor unit and an outdoor unit and a control device for controlling an operation of the air conditioner) may include: connecting the control device with the outdoor unit for communication; determining whether there are data to be updated from the control device to the outdoor unit; transmitting the data to the outdoor unit when there are data; storing the data in a first memory of the outdoor unit; and storing the data from the first memory to a second memory of the outdoor unit when an update execute signal is provided from the control device.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A network system, comprising:

an air conditioner including an indoor unit and an outdoor unit;

a control device to update set data in the air conditioner; and a control unit provided in the outdoor unit to control an operation of the outdoor unit and a first memory in the outdoor unit, the control unit to receive update data from the control device, the first memory to store update data received from the control device, and the control unit including a second memory to selectively store the update data stored in the first memory based on whether an update execute signal is received from the control device, wherein the control device transmits, to the air conditioner, control data for controlling an operation of the air conditioner, and when the control data and the update data are substantially simultaneously transmitted to the air conditioner, the control unit processes the transmitted control data and update data such that the update data and the control data are alternately processed at a time based on an amount of data or format of data.

2. The network system according to claim 1, wherein the control unit further includes a boot loader to read the update data stored in the first memory and to provide the update data in the second memory when the update execute signal is received from the control device.

3. The network system according to claim 2, wherein the boot loader initializes data stored in the second memory.

4. The network system according to claim 2, wherein an operation of the air conditioner stops when the update execute signal is received from the control device; and the update data are loaded in the second memory while the operation of the air conditioner is stopped.

5. The network system according to claim 2, further comprising a processing unit to provide update data in the first memory after the update data is transmitted to the control unit.

6. The network system according to claim 1, wherein the control device monitors an operating state of the air conditioner, and the update data are transmitted to the control unit when it is determined that an operation of the air conditioner has stopped.

7. The network system according to claim 1, wherein the control device comprises:

a first control device to monitor an operation of the air conditioner or to provide the update execute signal; and a converter to convert a data format in order to transmit data received from the first control device to the air conditioner.

8. The network system according to claim 1, wherein the air conditioner includes a plurality of air conditioners, and the update data are updated simultaneously in the plurality of air conditioners.

9. A method of a network system that includes an air conditioner with indoor and outdoor units and a control device for controlling an operation of the air conditioner, the method comprising:

connecting the control device to the outdoor unit;

determining whether there are data to be updated from the control device to the outdoor unit;

transmitting the data to a control unit of the outdoor unit when it is determined that there are data to be updated, the control unit controlling an operation of the outdoor unit;

storing the data in a first memory of the outdoor unit;

receiving, at the outdoor unit, an update execute signal from the control device; and transferring the data from the first memory to a second memory of the outdoor unit after the update execute signal is received from the control device, wherein the control device transmits, to the air conditioner, control data for controlling an operation of the air conditioner, and when the control data and the update data are substantially simultaneously transmitted to the air conditioner, the control unit processes the transmitted control data and update data such that the update data and the control data are alternately processed at a time based on an amount of data or a format of data.

10. The method according to claim 9, wherein the update execute signal is provided when a set command is input at the control device.

11. The method according to claim 9, wherein the update execute signal is automatically provided from the control device to the outdoor unit when an operation of the outdoor unit stops.

12. The method according to claim 9, wherein connecting the control device to the outdoor unit includes:

connecting a first control device and a second control device via the internet; and connecting the second control device and the outdoor unit in a serial communication.

13. The method according to claim 9, wherein the data are stored in a second memory of each of a plurality of outdoor units.

* * * * *